US007278183B2

(12) United States Patent
Schluter

(10) Patent No.: US 7,278,183 B2
(45) Date of Patent: Oct. 9, 2007

(54) PIVOT HINGE ASSEMBLY

(75) Inventor: Robert Schluter, Tavernier, FL (US)

(73) Assignee: Middle Atlantic Products, Inc., Fairfield, NJ (US)

( * ) Notice: Subject to any disclaimer, the term of this patent is extended or adjusted under 35 U.S.C. 154(b) by 255 days.

(21) Appl. No.: 10/924,288

(22) Filed: Aug. 23, 2004

(65) Prior Publication Data

US 2005/0077255 A1 Apr. 14, 2005

Related U.S. Application Data

(60) Provisional application No. 60/500,799, filed on Sep. 5, 2003.

(51) Int. Cl.

| | |
|---|---|
| ***E05D 5/00*** | (2006.01) |
| ***E05D 5/12*** | (2006.01) |
| ***E05D 5/14*** | (2006.01) |
| ***E05D 11/00*** | (2006.01) |

(52) U.S. Cl. ..... 16/262; 16/263; 16/380

(58) Field of Classification Search ..... 16/254, 16/260–264, 273, 380; 312/223.1, 223.2
See application file for complete search history.

(56) References Cited

U.S. PATENT DOCUMENTS 506,006 A * 10/1893 Kreider ..... 403/161
3,468,570 A * 9/1969 Mielke ..... 403/11
4,937,916 A * 7/1990 Redman ..... 16/243
5,930,867 A * 8/1999 Grzeskowiak ..... 16/244
5,931,554 A * 8/1999 Koopman ..... 312/405
6,591,451 B2 * 7/2003 Gruber et al. ..... 16/262
6,808,333 B2 * 10/2004 Friesen et al. ..... 403/158
6,922,872 B2 * 8/2005 Gruber ..... 16/260

OTHER PUBLICATIONS

Brochure: SR-40-22 Swinging Rack, Middle Atlantic Products, Inc., 96-045B/rev 1a/1/24/01, dated Jan. 24, 2001.
Brochure: DWR Series 19" Wall Cabinet, Middle Atlantic Products, Inc., p. 40, undated.

* cited by examiner

*Primary Examiner*—Robert J. Sandy
(74) *Attorney, Agent, or Firm*—Drinker Biddle & Reath LLP

(57) ABSTRACT

A pivot hinge assembly for mounting a cabinet to a frame. The assembly includes a first hinge pin bushing adapted to mount to the cabinet and a second hinge pin bushing adapted to mount to the frame. The hinge pin bushings each have a hole formed through it for receiving a pin, and substantially complementary mating surfaces for providing a bearing interface. The pin includes a head and a terminal end. Threads are formed on a portion of the pin which engage with threads in the second hinge pin bushing. A locking mechanism is removably attached to the pin near its terminal end. In one embodiment, the assembly includes a wear strip mounted to either the cabinet or the frame and which provides a low friction bearing surface between the cabinet and the frame.

5 Claims, 4 Drawing Sheets

PIVOT HINGE ASSEMBLY

RELATED APPLICATION

This application is related to and claims priority from U.S. Provisional Application Ser. No. 60/500,799, filed Sep. 5, 2003, which is incorporated herein by reference in its entirety.

FIELD OF THE INVENTION

The present invention relates to a hinge assembly and, more particularly, to a pivot hinge assembly that pivotably attaches a cabinet to a frame while inhibiting removal of the cabinet when the cabinet is closed.

BACKGROUND OF THE INVENTION

Over the last few decades, the use of electrical equipment in everyday systems has increased dramatically, replacing many mechanical devices. This use has been prompted, to a large extent by the increased usage of computer systems for controlling everything from data systems to environmental controls.

With the increased growth in the use of electrical equipment has come the increased need to house and protect the equipment, especially from tampering. Yet servicing the equipment is also important, and in many cases drives the design of the equipment housing.

Various rack systems have been produced over the years to store electrical and electronic equipment. The basic deficiency with many of the prior swing or hinged rack storage systems has been the ability to access the system, even when closed, through the hinge. In an attempt to counter this, some systems have moved the hinge internally. One such system is the SR-40-22 swinging rack enclosure sold by Middle Atlantic Products, Inc. The swinging rack includes a wall mounted frame (backpan) and a cabinet or control box hinged to the backpan. Racks or shelves for holding electrical equipment are mounted on either or both the backpan or the control box. The unit is designed such that, when the control box is closed, the electrical equipment is shielded from access.

In this swinging rack design, the hinge is located internal to the unit such that, when the control box is closed, the hinge cannot be accessed, thus protecting the contents from being vandalized. The hinge includes two holes formed in the upper and lower corners on one side of the control box and back panel, and a pin. The hinge is assembled by aligning the holes and inserting the pin from outside the cabinet. To prevent removal, the pin is then locked into place with a cotter pin.

While this swinging rack system provides a secure system for protecting electronic components, it requires two individuals to mount the control box to the backpan, one to hold the control box and the other to align the holes and insert the hinge pin.

A need exists for an improved rack system with a hinged door that is easy to assemble.

SUMMARY OF THE INVENTION

The present invention relates to a pivot hinge assembly for use in mounting a cabinet to a frame. The hinge assembly includes a first hinge pin bushing adapted to mount to a wall of the cabinet and a second hinge pin bushing adapted to mount to a wall of the frame. The hinge pin bushings each have a hole formed through it for receiving a pin, and substantially complementary mating surfaces for providing a bearing interface.

The pin is removably disposable within the holes formed in the first and second hinge pin bushings. The pin includes a head and a terminal end. The head is located on the opposite side of the second hinge pin bushing from the mating surface and a terminal end located on the opposite side of the first hinge pin bushing from the mating surface when the pin is disposed in the first and second hinge pin bushings. The pin has threads formed on a portion of it which are threadingly engageable with threads formed in the hole of the second hinge pin bushing.

The hinge assembly also includes a locking mechanism which is removably attached to the pin near its terminal end.

A rack system is also disclosed which incorporates the hinge assembly.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
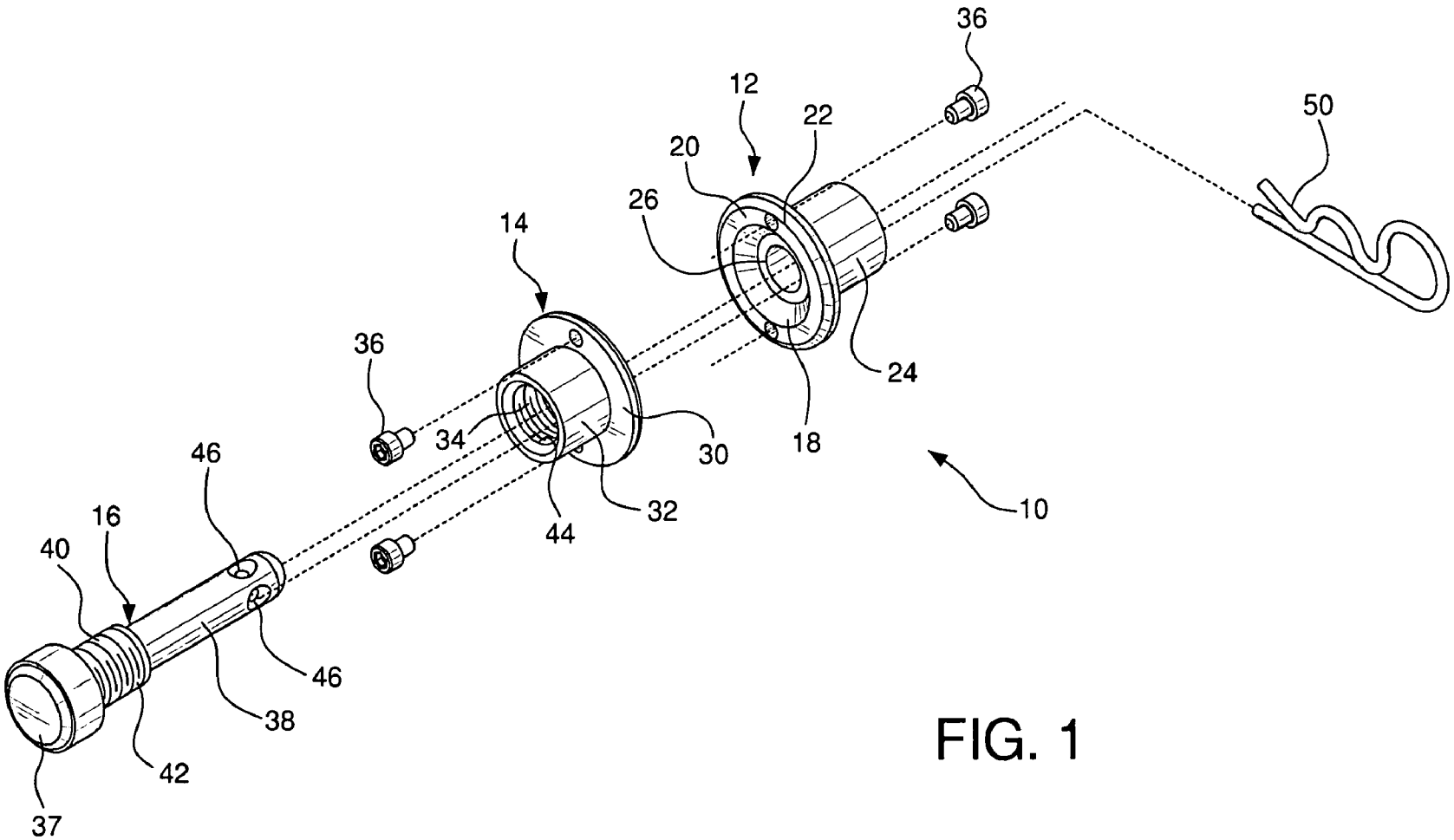
FIG. 1 is an exploded isometric view of one embodiment of the pivot hinge assembly according to the present invention.
Figure 2:
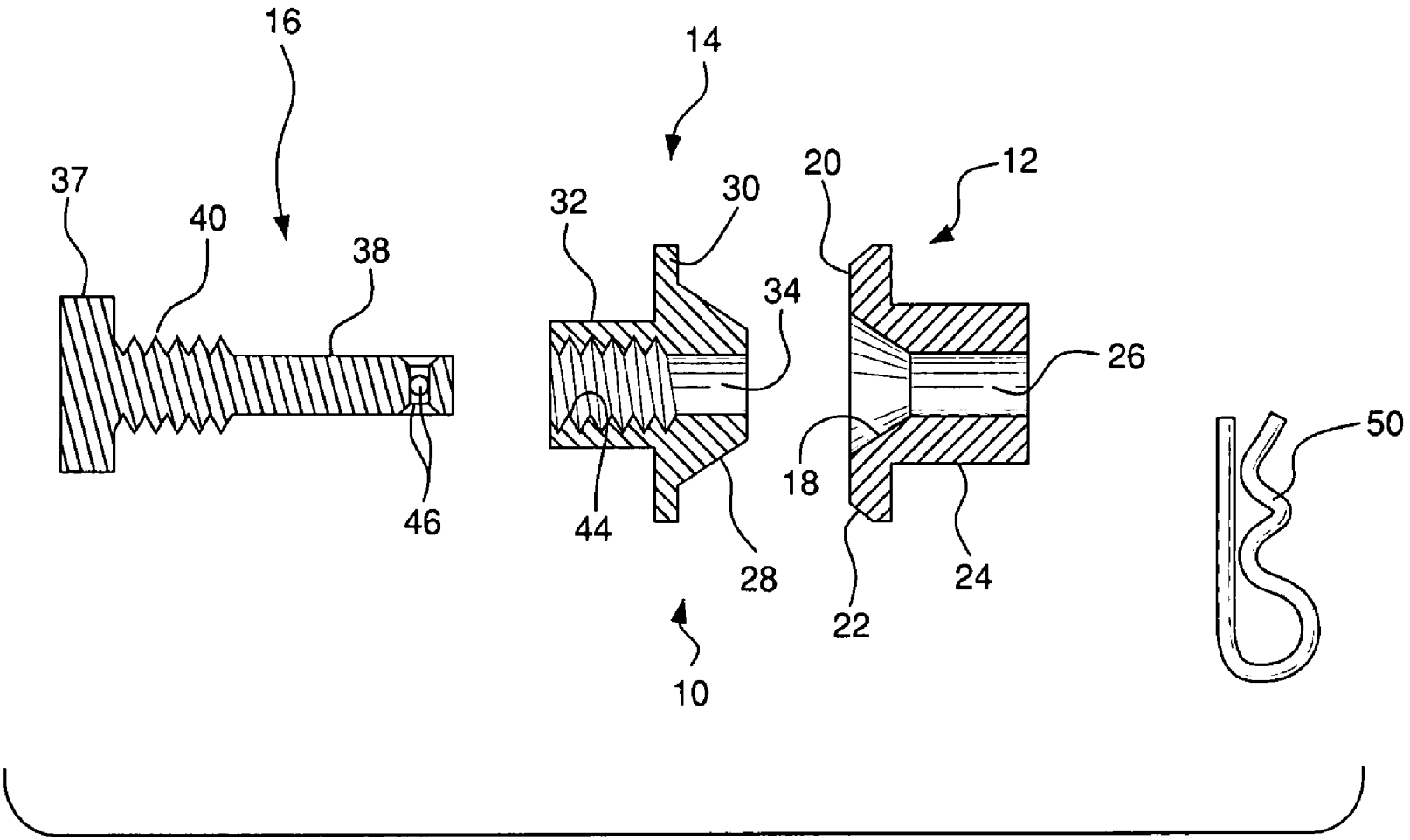
FIG. 2 is a partial cross-sectional view of the hinge assembly of FIG. 1 when fully assembled.

Referring now to the figures wherein similar reference numerals refer to similar parts throughout the various views, FIG. 1 is an exploded isometric view of a pivot hinge assembly 10 according to one embodiment of the invention. The assembly 10 includes a first hinge pin bushing 12, a second hinge pin bushing 14, and a pin 16. The pin 16 removably connects the first and second hinge pin bushings 12, 14 to one another.

The first hinge pin bushing 12 includes a seat 18 which preferably defines a substantially frusto-conical or similar truncated cone shape. While a truncated cone is the preferred shape of the embodiment shown in the figures, it should be readily apparent that other suitable recess or detent shapes may be substituted into the present invention. The seat is preferably centrally located within a flange 20. Although an annular circular flange 20 is shown in the figures, other shapes are clearly contemplated as the specific shape of the flange is not critical to the present invention. The flange 20 may include a beveled edge 22 as shown.

A stub shaft 24 is formed on the back surface of the flange 20 and is preferably centrally aligned with the seat 18. A hole 26 extends from the bottom of the seat through the stub shaft 24. As should be readily apparent, the stub shaft 24 operates as a bushing for the pin 16 when the pin is inserted into the first hinge pin bushing 12.

The second hinge pin bushing 14 includes a projection or nub 28 which preferably defines a substantially frusto-conical or similar projecting truncated cone shape. Preferably, the shape of the projection 28 is substantially complementary to the shape of the seat 18 so as to provide a mating interface between the first and second pin bushings 12, 14 as will be discussed in more detail below.

The projection 28 is preferably centrally located within a flange 30. As with the first hinge pin bushing, the flange 30 need not be circular as shown in the figures and may include a beveled edge.

A stub shaft 32 is formed on the back surface of the flange 30 and is preferably centrally aligned with the projection 28. A hole 34 extends from the tip of the projection 28 through the stub shaft 32. The combination of the hole and the stub shaft 32 forms a bushing for receiving the pin 16 when the pin is inserted into the second hinge pin bushing 14.

The first and second hinge pin bushings 12, 14 can be mounted to support structure using any suitable attachment mechanism, such as fastening, bonding, press fitting, welding, etc. In the illustrated embodiment fasteners 36 are used to attach the hinge pin bushings. Specifically, one or more fasteners, thread into holes formed in the back of the flanges. As will be discussed below, this assists in inhibiting removal of the assembly when mounted.

As shown in FIG. 1, the pin 16 preferably includes a head 37, a first shank portion 38 and a second, slightly larger shank portion 40. The larger shank portion 40 preferably includes external threads 42 which are designed to mate with complementary threads 44 formed on one of either the first or second hinge pin bushing 12, 14. In the illustrated embodiment, internal threads 44 are formed on at least a portion of the second hinge pin bushing 14. In this embodiment, the hole 34 formed in the second hinge pin bushing 14 has an inner diameter that is sized to receive the second larger shank portion 40 and the hole 26 on the first hinge pin bushing 12 has an inner diameter sized to receive the smaller first shank portion 38. While the pin 16 is shown with different diameter first and second shank portions, a constant diameter shank can be used just as well.

One or more through holes 46 are formed near the distal end of the pin 16, opposite from the head 37. The holes 46 are configured to receive a locking device, such as a cotter pin 50, as will be described in more detail below.

The pin 16 and hinge pin bushings 12, 14 are preferably made from a material having sufficient strength to accommodate the anticipated loads. Preferably the pin 16 is made from metal (steel, aluminum or brass), and the first and second hinge pin bushings are made from metal material. In one embodiment, the seat in the first hinge pin bushing 12 is a truncated cone with sides that taper at an angle of approximately 45 degrees from a first diameter of approximately 0.837 inches to a base diameter of approximately 0.587 inches. The flange has a thickness of approximately 0.125 inches. The pin hole is approximately 0.5 inches and the stub shaft has a length of approximately 0.875 inches. The dimensions of the second hinge pin bushing would preferably be similar and, for some features, complementary to those of the first hinge pin bushing.

Figure 4:
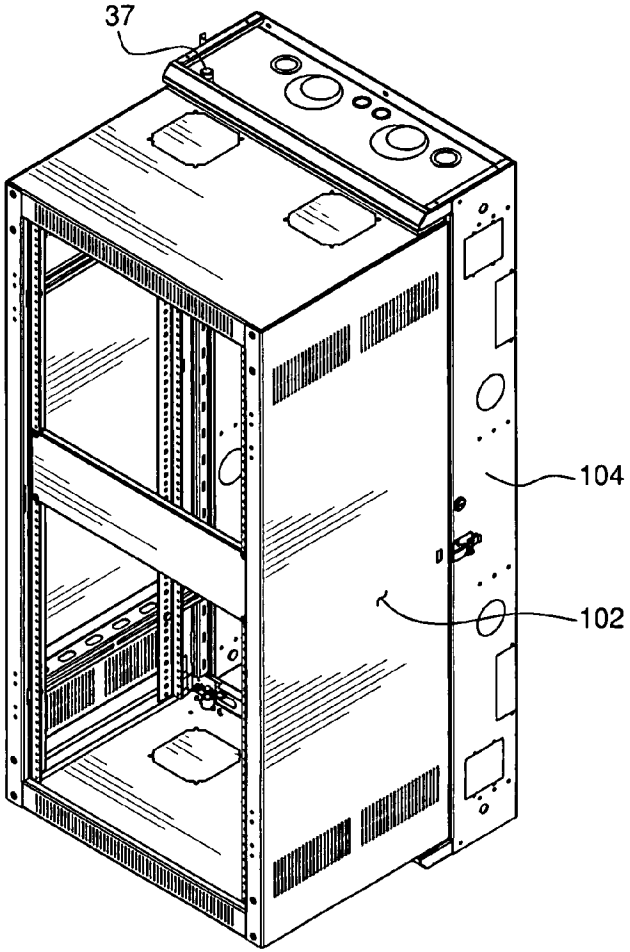
FIG. 4 is an isometric view of the rack assembly of FIG. 3 with the control box in a closed position.
Figure 3:
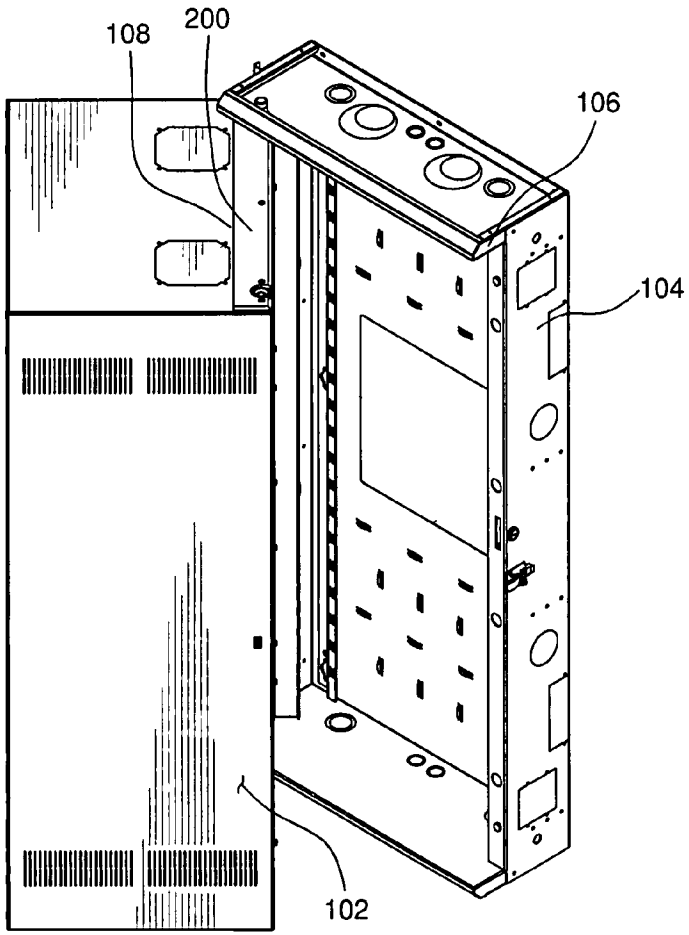
FIG. 3 is an isometric view of a rack assembly incorporating the hinge assembly of FIG. 1 with a control box in an open position.

Referring now to FIGS. 3-7, the hinge assembly of FIG. 1 is shown as it is intended for use in a preferred embodiment of an electronics rack assembly 100. In this embodiment, the hinge assembly is used to mount a cabinet or control box 102 onto a backpan or frame 104, thus providing a pivot hinge for the control box 102 relative to the backpan 104. FIG. 4 illustrates the rack assembly 100 with its control box in a closed position and FIG. 3 illustrates the assembly 100 with the control box 102 in its open or pivoted position. As should be readily apparent from the figures, only the head 37 of the pin is visible when the door is in its closed position.

Figures 5, 6, 7:
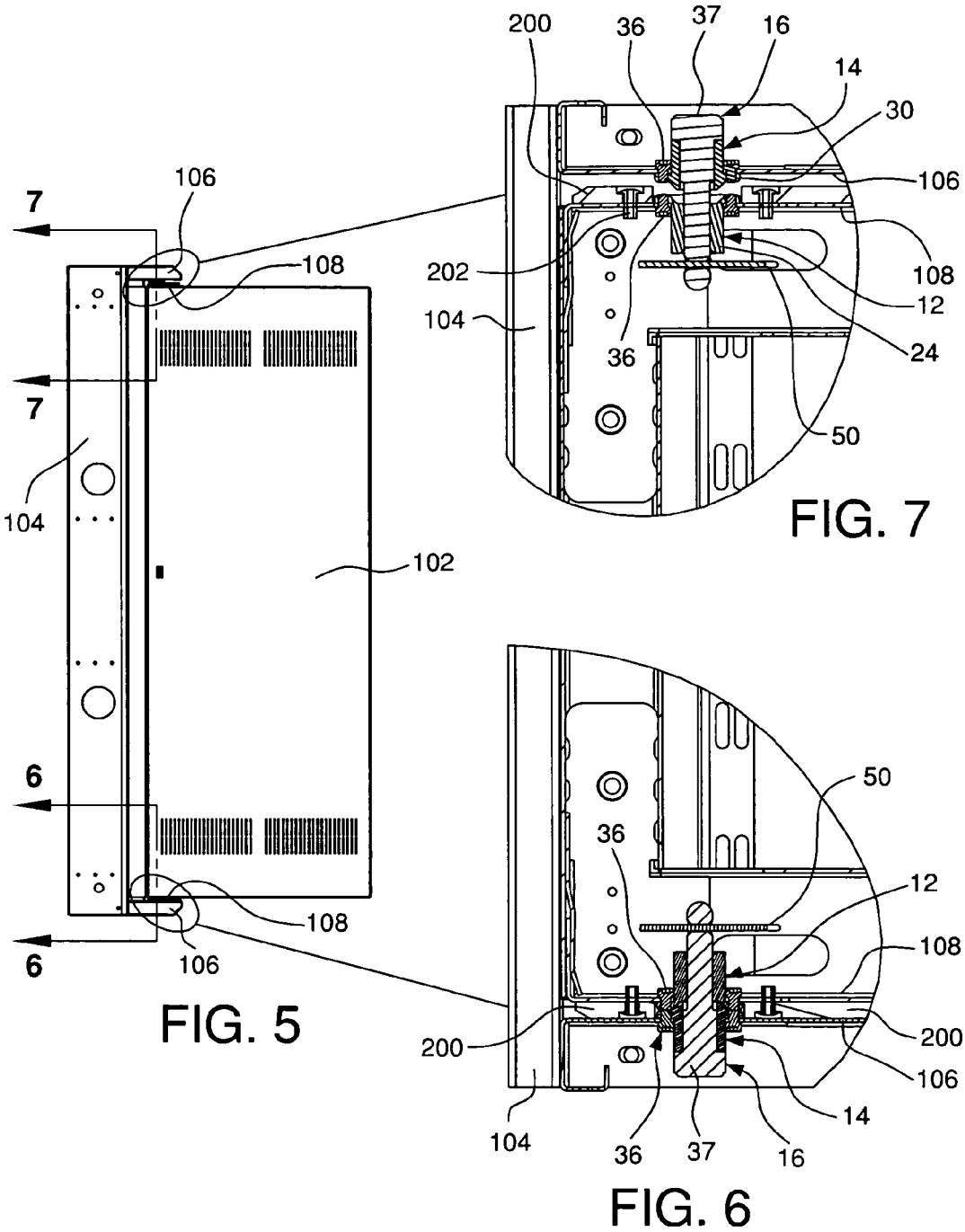
FIG. 5 is a side view of the rack assembly of FIG. 3.
FIG. 6 is a partial cross-sectional view of a lower hinge assembly taken along lines 6-6 in FIG. 5.
FIG. 7 is a partial cross-sectional view of an upper hinge assembly taken along lines 7-7 in FIG. 5.

FIG. 5 is a side view of the rack assembly 100 with the control box 102 in its closed portion. In this embodiment, the backpan 104 include an outwardly projecting wall or rim 106 on the top and bottom. FIGS. 6 and 7 are enlarged partial cross-sectional views illustrating the mounting of the pivot hinge assemblies 10 to the backpan 104 and the control box 102. Referring to FIG. 6, a lower pivot hinge assembly 10 is shown. As shown, the second hinge pin bushing 14 is mounted to the rim 106 of the backpan 104. The fasteners 36 thread through the rim 106 and engage with mating threads formed in the flange 30 of the second hinge pin bushing 14. As should be readily apparent from the figure, with the control box 102 in its closed position, removal of the fasteners 36 will not affect the operation of the hinge, nor permit the hinge to be disassembled. This configuration, thus, helps prevent vandalism to the internal components of the control box 102.

The first hinge pin bushing 12 is mounted to a lower wall or rim 108 on the control box 102. In the embodiment shown in the figure, fasteners 36 are used to attach the flange 22 to the control box rim 108 in a similar manner as the second hinge pin bushing 14.

As shown in FIG. 6, the hinge assembly 10 is constructed such that the seat 18 of the first hinge pin bushing 12 sits on (mates with) the projection 28 on the second hinge pin bushing 14. As such, the weight of the control box 102 is at least partially supported through compression and bearing on the second hinge pin bushing 14. Also, as should be readily apparent, the engagement between the first and second hinge pin bushings 12, 14 provides support for the control box 102 during and even after insertion of the pin 16.

The pin 16 is shown threaded into the stub shaft 32 of the second hinge pin bushing 14. The head 37 of the pin is located on the lower (exposed) side of the rim 106 of the backpan. To prevent the pin form being removed, a locking device is used to secure the pin 16 to the control box 102. Preferably the locking device is a removable fastener, such as a cotter pin. In the illustrated embodiment, the cotter pin 50 is shown engaged with the holes 46 in the terminal end of the pin 16. The control box is designed to provide internal access to the cotter pin 50 when the control box is in its open position, thus permitting engagement and removal of the cotter pin 50 as needed from inside the control box. When the cotter pin 50 is attached to the pin 16, the pin cannot be removed from outside of the control box, thus further inhibiting vandalism to the control box.

As discussed above, the threads assist in attaching the pin to the second hinge pin bushing 14. More particularly, by including threads, the present invention simplifies the mounting of the control box 102 to the backpan 104. To illustrate this, the installation of the control box will be briefly discussed. The control box is first positioned in place with the first hinge pin bushing 12 seating on the second hinge pin bushing 14 (or, more particularly, the projection 28 on the first hinge pin bushing 12 seating within the seat 18 on the second hinge pin busing 14. The bushings provide some support for the control box at this point. The pin 16 is then inserted into the second hinge pin bushing 14 and threaded into place. At this stage, the control box 102 is safely mounted to and supported by the backpan 104. As such, the operator can then open the control box 102 to insert the cotter pin to lock the hinge assembly 10 into place.

Referring to FIG. 7, an upper pivot hinge assembly 10 is shown. This assembly 10 is almost identical to the assembly discussed above with respect to FIG. 6. However, the first and second hinge pin bushings 12, 14 typically do not seat directly against one another since there needs to be some clearance provided in order to allow for the mounting of the control box 102 to the backpan 104.

Referring back to FIGS. 3, 6 and 7, in a heavy control box installation, it may be desirable to incorporate wear strips 200 into the present design to provide additional bearing support for the control box 102. More particularly, wear strips 200 may be mounted adjacent to the hinge assemblies 10 and preferably extend at least partially along the edge of the control box 102 as shown in FIG. 6. The wear strips 200 can be attached to the top and/or bottom of the control box through any suitable mechanism. Removable fasteners 202 are preferred so as to permit the replacement of the wear strips 200 when needed. The wear strips 200 preferably have a height that is approximately the same as the space between the control box 102 and the backpan 104 on the lower installation of the hinge assembly 10 in FIG. 6 (which is approximately the combined thickness of the flanges 20, 30 of the first and second hinge pin bushings). This permits the wear strip 200 to provide contact between the control box 102 and the backpan 104, and thereby operate as a low friction bearing surface for carrying some of the weight to the control box 102. However, the wear strip can have a larger or smaller height and still provide suitable support.

In one preferred embodiment, the wear strip is made from ultra high molecular weight polyethylene and has a thickness of approximately 3/16ths inches. This material provides relatively low sliding friction, thus minimizing its affect on the opening and closing of the control box. Those skilled in the art would be readily capable of substituting other types of materials for the preferred material described above depending on the anticipated usage of the hinge assembly.

Although the wear strip is shown mounted on the control box, it could just as readily be mounted to the rim 106 of the backpan. Also, while the rack assembly is shown with the hinge assembly located to permit pivoting about a vertical axis, it is also contemplated that the hinges could be mounted so as to permit pivoting about a horizontal axis.

Furthermore, it should be readily apparent that the first and second hinge pin bushings 12, 14 can be installed in a reverse manner without detracting from the invention.

The hinge assembly 10 disclosed above provides a novel and innovative device for mounting a cabinet to a frame, while preventing access through the hinge when the cabinet is closed. When used with a control box, the hinge assembly permits a user to safely and easily mount the control box to a backpan with little assistance.

The present invention may be embodied in other specific forms without departing from the spirit or essential attributes thereof and, accordingly, reference should be made to the appended claims, rather than to the foregoing specification, as indicating the scope of the invention.

The invention claimed is:

1. A pivot hinge assembly for use in mounting a cabinet to a frame, the pivot hinge comprising:

a first hinge pin bushing adapted to mount to a wall of a cabinet, the first hinge pin bushing having a hole formed through it;

a second hinge pin bushing adapted to mount to a wall of a frame, the second hinge pin bushing having a hole formed through it;

the first and second hinge pin bushings having substantially complementary mating surfaces for providing a bearing interface;

a pin removably disposable within the holes formed in the first and second hinge pin bushings, the pin having a head that is located on the opposite side of the second hinge pin bushing from the mating surface and a terminal end located on the opposite side of the first hinge pin bushing from the mating surface when the pin is disposed in the first and second hinge pin bushings, the pin having threads formed on a portion of it which are threadingly engageable with threads formed in the hole of the second hinge pin bushing;

a locking device removably attached to the pin near its terminal end;

wherein the mating surfaces include a recessed seat on the first hinge pin bushing and a projecting nub on the second hinge pin bushing that is shaped to seat in the recessed seat, the hole in the first hinge pin bushing being axially aligned with the recessed seat and extending from a bottom of the recessed seat to an opposite end of the first hinge pin bushing, the hole in the second hinge pin bushing being axially aligned with the projecting nub and extending from a top end of the projecting nub to an opposite end of the second hinge pin bushing; and wherein the first hinge pin bushing includes a flange which substantially surrounds the recessed seat, the flange including a plurality of mounting holes for mounting the first hinge pin bushing to a structure; and wherein the second hinge pin bushing includes a flange which substantially surrounds the projecting nub, the nub projecting out from one side of the flange, the flange including a plurality of mounting holes for mounting the second hinge pin bushing to a structure.

2. A pivot hinge assembly according to claim 1 wherein the recessed seat on the first hinge pin bushing has a substantially frustoconical shape, and wherein the projecting nub on the second hinge pin bushing is substantially frustoconical in shape so as to complement the shape of the recess.

3. A pivot hinge assembly according to claim 2 wherein the second hinge pin bushing includes a stub shaft portion which extends from the opposite side of the flange from the projecting nub, the hole in the second hinge pin bushing extending through the stub shaft portion, the stub shaft portion having internal threads formed on at least a portion of it, and wherein the pin includes threads formed on a portion of it that are adapted to threadingly mate with the threads on the second hinge pin bushing.

4. A pivot hinge assembly according to claim 3 wherein the first hinge pin bushing includes a stub shaft portion which extends from the flange, the hole in the first hinge pin bushing extending through the stub shaft portion.

5. A pivot hinge assembly according to claim 4 wherein the seat in the first hinge pin bushing tapers at an approximately 45 degree angle from a first diameter of approximately 0.8 inches to a base diameter of approximately 0.5 inches, and wherein the hole formed in the first hinge pin bushing has a diameter of approximately 0.5 inches; and wherein the projecting nub on the second hinge pin bushing tapers at an approximately 45 degree angle from a first outer diameter of approximately 0.8 inches to a second outer diameter of approximately 0.5 inches, and wherein the hole formed in the second hinge pin bushing has at least a portion that has a diameter that is larger than 0.5 inches.

* * * * *